United States Patent [19]

Yasuhara

[11] Patent Number: 4,491,100

[45] Date of Patent: Jan. 1, 1985

[54] CONTROL SYSTEM FOR A GLOW PLUG OF AN INTERNAL COMBUSTION ENGINE

[75] Inventor: Seishi Yasuhara, Yokosuka, Japan

[73] Assignee: Nissan Motor Company, Limited, Japan

[21] Appl. No.: 490,233

[22] Filed: Apr. 29, 1983

[51] Int. Cl.[3] ..... F02P 19/02

[52] U.S. Cl. ..... 123/145 A; 123/179 BG

[58] Field of Search ..... 123/145 A, 179 GB, 179 B, 123/146.5 D, 146.5 A, 179 H, 179 R; 361/264, 266; 219/267, 270

[56] References Cited

U.S. PATENT DOCUMENTS

| | | | |
|---|---|---|---|
| 4,377,138 | 3/1983 | Mitani et al. | 123/145 A |
| 4,399,781 | 8/1983 | Tsukasaki | 123/145 A |

FOREIGN PATENT DOCUMENTS

| | | | |
|---|---|---|---|
| 2341205 | 2/1975 | Fed. Rep. of Germany . | 123/145 A |
| 3007129 | 8/1980 | Fed. Rep. of Germany . | 123/145 A |
| 5514877 | 9/1980 | Japan | 123/145 A |

*Primary Examiner*—Raymond A. Nelli

*Attorney, Agent, or Firm*—Lowe, King, Price & Becker

[57] ABSTRACT

A first device is provided for selectively activating and deactivating a glow plug. A microcomputer system is connected to the first device for controlling the first device. A DC power source is electrically connected to the microcomputer system and a starting motor for supplying DC electrical power to the microcomputer system and the starting motor to activate them. The microcomputer system becomes inactive and causes the first means to deactivate the glow plug when the voltage of the DC electrical power drops below a minimum rating value. A switch is disposed in the electrical connection between the starting motor and the power source for selectively effecting and interrupting activation of the starting motor. A second device is provided for activating the glow plug when the switch effects activation of the starting motor regardless of whether or not the voltage of the DC electrical power drops below the minimum rating value.

3 Claims, 5 Drawing Figures

25
TEMP. SENSOR
TIME SENSOR
26
SPEED SENSOR
27
INDICATOR
28
S
TW
t
40
24
22
23
17
19
10
11
12
13
14
CONTROL UNIT
15
20
18
21
GLOW PLUG
16
M

25
TEMP. SENSOR
Tw
15 CONTROL UNIT
31
26
TIME SENSOR
t
CPU
RAM
32
ROM
33
SPEED SENSOR
27
S
20
I/O CIRCUIT
FROM JUNCTION OF RELAY WINDINGS 18 & 23
28
INDICATOR
30

CONTROL SYSTEM FOR A GLOW PLUG OF AN INTERNAL COMBUSTION ENGINE

BACKGROUND OF THE INVENTION

This invention relates to a control system for a glow plug of an internal combustion engine, such as a diesel engine.

Diesel engines have glow plugs to preheat the engine combustion chambers before and during engine cranking in order to reliably start the engine. It is desirable that the length of time during which the glow plugs are activated varies as a function of engine operating conditions, such as the temperature of the engine coolant.

In the case where a microcomputer system is used to control the glow plugs in response to the engine operating conditions, the following problem may arise: when the engine starting motor is activated to crank the engine, power supply voltage applied to the microcomputer system may periodically drop below the minimum rating value necessary to operate the microcomputer system, since the power supply voltage is also being applied at that time to the starting motor. These power supply voltage drops generally cause the glow plugs to be inactivated undesirably. In this way, operation of the glow plugs may be unreliable during engine cranking.

SUMMARY OF THE INVENTION

It is an object of this invention to provide a more stable control system for a glow plug of an internal combustion engine.

In accordance with this invention, a control system for a glow plug of an internal combustion engine equipped with a starting motor includes a first device for selectively activating and deactivating the glow plug. A microcomputer system is connected to the first device for controlling that first device. A DC power source is electrically connected to the microcomputer system and the starting motor for supplying DC electrical power to the microcomputer system and the starting motor to activate them. The microcomputer system becomes inactive and causes the first means to deactivate the glow plug when the voltage of the DC electrical power drops below a minimum rating value. A switch is disposed in the electrical connection between the starting motor and the power source for selectively effecting and interrupting activation of the starting motor. A second device is provided for activating the glow plug when the switch effects activation of the starting motor regardless of whether or not the voltage of the DC electrical power drops below the minimum rating value.

The above and other objects, features and advantages of this invention will be apparent from the following description of preferred embodiments thereof, taken in conjunction with the drawings.

BRIEF DESCRIPTION OF THE DRAWINGS

Like or same elements are denoted by the same reference numerals throughout the drawings.

DESCRIPTION OF THE PREFERRED EMBODIMENTS

Figure 1:
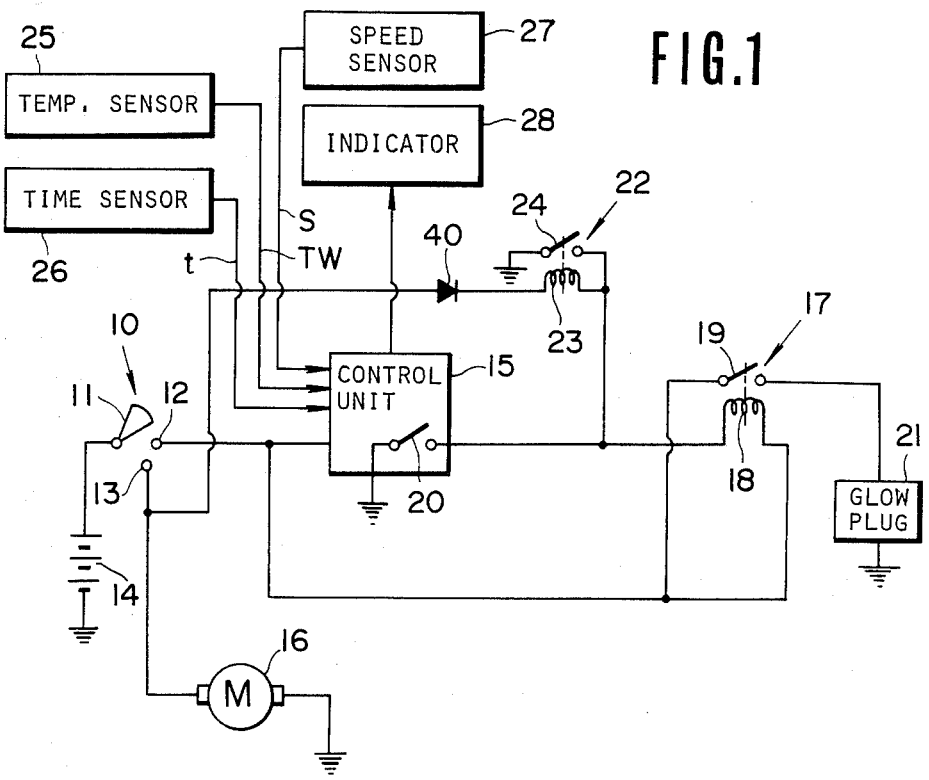
FIG. 1 is a diagram of a control system for a glow plug of an internal combustion engine according to a first embodiment of this invention.

With reference to FIG. 1 showing a first embodiment of this invention, an engine key switch 10 includes a movable contact 11 and fixed contacts 12 and 13. When the key switch 10 is actuated from the rest or open position, the movable contact 11 first comes into contact with the fixed contact 12, and then comes into contact with the other fixed contact 13 while maintaining contact with the fixed contact 12. As the key switch 10 is reversed from the fully closed position, the movable contact 11 begins to move out of contact with the fixed contact 13 firstly while maintaining contact with the other fixed contact 12, and then moves out of contact with the fixed contact 12. The primary operative position of the key switch 10 is defined to be the state in which the movable contact 11 is in contact with only the first fixed contact 12. The secondary operative position of the key switch 10 is defined to be the state in which the movable contact 11 is in contact with both of the fixed contacts 12 and 13.

The positive terminal of a DC power source 14, such as a storage battery, is connected to the movable contact 11 of the key switch 10. The negative terminal of the power source 14 is grounded. The first fixed contact 12 of the key switch 10 is connected to the positive power supply input terminal of an electronic control unit 15. The negative power supply input terminal of the control unit 15 is grounded. When the movable contact 11 comes into contact with the fixed contact 12, DC electrical power is conducted from the power source 14 to the control unit 15 so that the control unit 15 can be activated.

The second fixed contact 13 of the key switch 10 is grounded via a starting motor 16. When the movable contact 11 of the key switch 10 comes into contact with the fixed contact 13, DC electrical power is conducted from the power source 14 to the starting motor 16 so that the starting motor 16 can be activated. When the movable contact 11 separates from the fixed contact 13, no electrical power is supplied to the starting motor 16 so that the starting motor 16 is deactivated. The starting motor 16 is conventionally coupled to the crankshaft of an internal combustion engine (not shown) to rotate the crankshaft, i.e., crank the engine.

A relay 17 has a control winding 18 and a normally open switch 19. The relay switch 19 is closed and opened when the control winding 18 is energized and de-energized, respectively. One end of the relay winding 18 is connected to the first fixed contact 12 of the key switch 10, and the other end of the relay winding 18 is grounded via a glow plug control switch 20. Under conditions where the movable contact 11 of the key switch 10 is in contact with the fixed contact 12, when the control switch 20 is closed, DC electrical power is conducted from the power source 14 to the relay winding 18 so that the relay winding 18 is energized, thereby closing the relay switch 19. Under the same conditions, when the control switch 20 is opened, no electrical power is supplied to the relay winding 18 so that the relay winding 18 is de-energized, thereby opening the relay switch 19. When the movable contact 11 separates from the fixed contact 12, again no electrical power is supplied to the relay winding 18, opening the relay switch 19 even in the case where the control switch 20 is closed. The control switch 20 is included as part of the control unit 15.

A glow plug section 21 consists of a glow plug, a parallel combination of glow plugs, or a series combination of glow plugs. The number of glow plugs generally equals that of combustion chambers of the engine so that a glow plug is provided in each of the combustion chambers in a well-known manner. The first fixed contact 12 of the key switch 10 is grounded via the series combination of the relay switch 19 and the glow plug section 21. Under conditions where the movable contact 11 of the key switch 10 is in contact with the fixed contact 12, when the relay switch 19 is closed, DC electrical power is conducted from the power source 14 to the glow plug section 21 so that the glow plug section 21 is activated. Under the same conditions, when the relay switch 19 is opened, no electrical power is supplied to the glow plug section 21 so that the glow plug section 21 is deactivated. When the movable contact 11 separates from the fixed contact 12, again no electrical power is supplied to the glow plug section 21 so that the glow plug section 21 is deactivated.

Another relay 22 has a control winding 23 and a normally open switch 24. The relay switch 24 is closed and opened when the control winding 23 is energized and de-energized, respectively. One end of the relay winding 23 is connected to the junction of the control switch 20 and the other relay winding 18, and the other end of the relay winding 18 is connected to the cathode of a diode 40. The anode of the diode 40 is connected to the second fixed contact 13 of the key switch 10. The junction of the control switch 20 and the relay winding 18 is grounded via the relay switch 24. Under conditions where the control switch 20 is closed, when the movable contact 11 of the key switch 10 comes into contact with the fixed contact 13, DC electrical power is conducted to the relay winding 23 via the diode 48 so that the relay winding 23 is energized, thereby closing the relay switch 24. As long as the movable contact 11 remains in contact with the fixed contact 13, the first closing of the relay switch 24 keeps the relay winding 23 energized regardless of the state of the control switch 20 so that the relay switch 24 remains closed. In this way, the relay 22 performs lock-up action or self-energization. When the movable contact 11 separates from the fixed contact 13, no electrical power is supplied to the relay winding 23 so that the relay winding 23 is de-energized, thereby opening the relay switch 24.

In the case where the movable contact 11 of the key switch 10 is in contact with only the first fixed contact 12 thereof, the diode 40 prevents current flow from the power source 14 to the starting motor 16 via the key switch 10, the control unit 15 or the relay winding 18, the other relay winding 23, and the diode 40.

A temperature sensor 25 is provided to sense the temperature of the engine, and preferably the temperature of the engine coolant. The temperature sensor 25 outputs an analog signal $T_W$ whose voltage varies as a function of the engine or engine coolant temperature. The engine temperature signal $T_W$ is applied to the control unit 15.

A time sensor 26 is provided to determine the time elapsed since the engine was last turned off. The time sensor 26 outputs a digital signal t representing the time elapsed since the last engine operation. The time signal t is applied to the control unit 15.

A speed sensor 27 is provided to determine the rotational speed of the crankshaft of the engine. The speed sensor 27 outputs a digital signal S representing the rotational speed of the crankshaft. The engine speed signal S is applied to the control unit 15.

An indicator 28, such as a lamp, is provided to indicate whether or not preheating by the glow plug section 21 is complete. The indicator 28 is connected to the control unit 15 to be controllably activated and deactivated by the latter.

The control unit 15 operates the control switch 20 in response to the signals $T_W$, t, and S representing the engine temperature, the time elapsed since the previous operation of the engine, and the rotational speed of the crankshaft, respectively.

Figure 2:
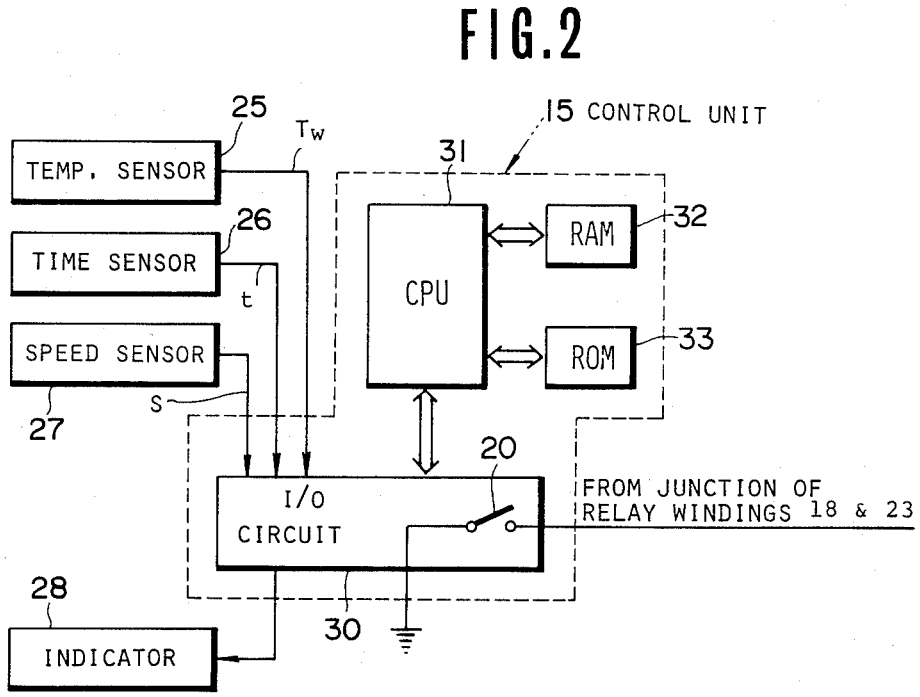
FIG. 2 is a diagram of the control unit of FIG. 1.

As is shown in FIG. 2, the control unit 15 consists of a digital microcomputer system including an input/output (I/O) interface circuit 30, a central processing unit (CPU) 31, a read/write or random-access memory (RAM) 32, and a read-only memory (ROM) 33. The central processing unit 31 is connected to the I/O circuit 30 and the memories 32 and 33. The I/O circuit 30 is connected to the sensors 25, 26, and 27 to receive the signals $T_W$, t, and S therefrom. The I/O circuit 30 is also connected to the indicator 28 to apply a control signal defining activation and deactivation of the indicator 28.

The I/O circuit 30 includes an analog-to-digital converter (not shown), which converts the analog engine temperature signal $T_W$ into a corresponding digital signal so that the central processing unit 31 can handle the engine temperature data.

The I/O circuit 30 also includes the control switch 20. The control switch 20 is composed of an analog switch, which has a control terminal and a pair of switch terminals. When a high-level voltage or signal is applied to the control terminal, the path across the switch terminals become conductive. When a low-level voltage or signal is applied to the control terminal, the path across the switch terminals become nonconductive. The central processing unit 31 controls the signal applied to the control terminal of the analog switch. One of the switch terminals of the analog switch is grounded, and the other switch terminal is connected to the junction between the relay windings 18 and 23.

The control switch 20 may also be an NPN power transistor, the emitter of which is grounded and the collector of which is connected to the junction between the relay windings 18 and 23. When a high-level voltage or signal is applied to the base of the transistor, the collector-emitter path thereof becomes conductive. When a low-level voltage or signal is applied to the base of the transistor, the collector-emitter path thereof becomes nonconductive. The central processing unit 31 controls the signal applied to the base of the transistor.

The I/O circuit 30, the central processing unit 31, and the memories 32 and 33 forming the control unit 15 are connected to the power source 14 via the key switch 10 to receive DC electrical power therefrom. This power supply connection of the control unit 15 to the power source 14 is eliminated in FIG. 2 for simplicity of illustration. The control unit 15 is designed to become inactive when the voltage of the DC electrical power applied to the control unit 15 drops below a minimum rating value, such as 5 volts, required by the microcomputer system forming the control unit 15. When the control unit 15 becomes inactive, the control switch 20 automatically, forcedly becomes nonconductive or open, since a high-level signal will no longer be applied to the control terminal of the analog switch or the base of the transistor constituting the control switch 20. In this invention, the forced opening of the control switch 20 can be prevented from disadvantageously affecting operation of the glow plug section 21 as described hereinafter.

In operation, when the key switch 10 is actuated from the rest or open position to the primary operative position in which the movable contact 11 is in contact with the first fixed contact 12, the control unit 15 starts to operate in accordance with a program stored in the memory 33.

Figure 3:
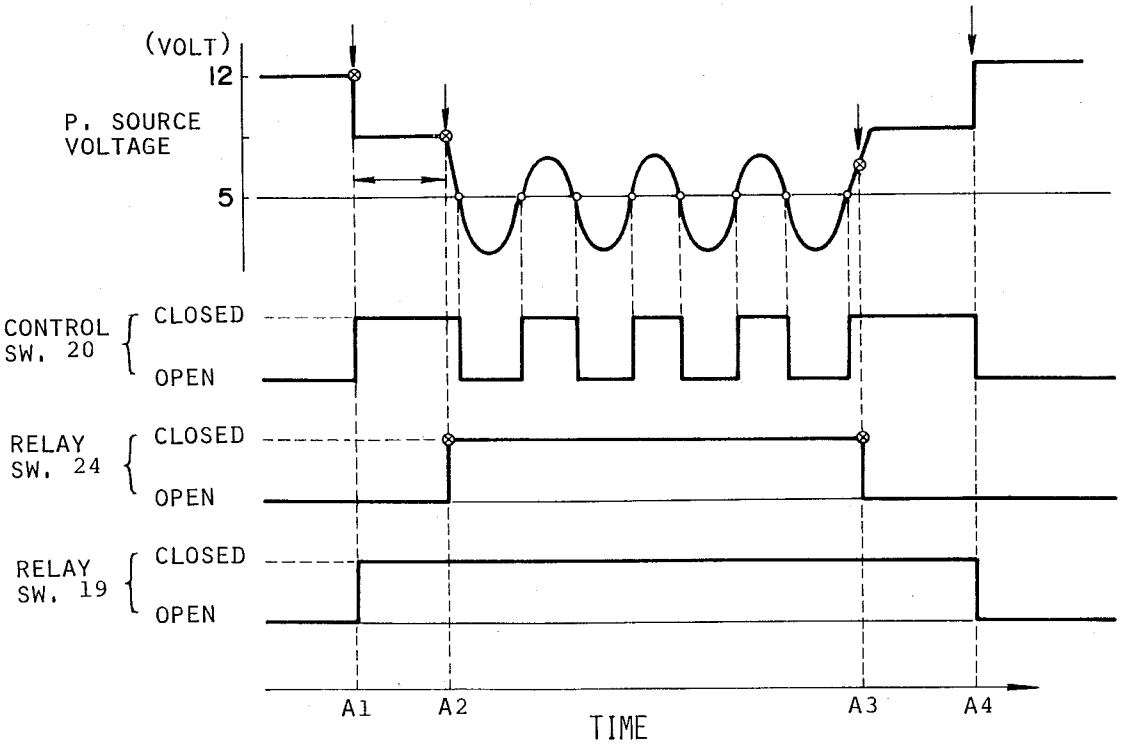
FIG. 3 is a time chart showing conditions of the several elements of FIG. 1.

First, the control unit 15 closes the control switch 20 as shown at a time point $A_1$ of FIG. 3, and calculates the length of time necessary to complete preheating by the glow plug section 21 on the basis of the engine temperature and the time elapsed since the engine was last turned off, indicated by the signals $T_W$ and t respectively. This calculation is performed such that the preheating time increases as the engine temperature decreases and/or as the time elapsed since the previous operation of the engine increases.

As soon as the preheating time calculation is complete, the control unit 15 activates the indicator 28. Closing of the control switch 20 enables the relay winding 18 to be energized, thereby also closing the relay switch 19 and activating the glow plug section 21, as shown at the time point $A_1$ of FIG. 3. Activating the indicator 28 reports the start of activation of the glow plug section 21 and also reports the fact that preheating is not yet finished. Activating the glow plug section 21 causes the voltage across the power source 14 to drop from a normal value to a considerably lower value, e.g., from 12 volts to 7.5 volts as shown at the time point $A_1$ of FIG. 3.

After the calculated length of time elapsed from the closing of the control switch 20, that is, the activation of the glow plug section 21, the control unit 15 deactivates the indicator 28. Deactivating the indicator 28 reports the completion of preheating and also reports the fact that the engine is ready to start. Generally, this report urges the engine operator to perform the next step toward starting the engine.

When the key switch 10 is subsequently further actuated to the secondary operative position in which the movable contact 11 is in contact with both of the fixed contacts 12 and 13, the starting motor 16 is activated and the relay winding 23 is energized. Activating the starting motor 16 cranks the engine, and causes the voltage across the power source 14 to drop as shown at a time point $A_2$ of FIG. 3. While the starting motor 16 is running, the voltage across the power source 14 fluctuates periodically around the 5-volt level as shown in the time period from the time point $A_2$ to a subsequent time point $A_3$ of FIG. 3, since rotation of the crankshaft exerts a cyclic load on the starting motor 16. The voltage across the power source 14 is most likely to drop below 5 volts during engine cranking under conditions where the power source 14 has been charged insufficiently and/or the atmosphere is so cold as to excessively increase the load on the starting motor. Meanwhile, energization of the relay winding 23 causes the relay switch 24 to close as shown at the time point $A_2$ of FIG. 3. The relay switch 24 remains closed due to the lock-up action or the self-energization of the relay 22 until the time point $A_3$ of FIG. 3 at which time the key switch 10 will normally be returned to its primary operative position so that the movable contact 11 will separate from the fixed contact 13.

When the voltage across the power source 14 drops below 5 volts, the control switch 20 is opened as shown in FIG. 3 due to the fact that the control unit 15 becomes inactive under these voltage conditions as described previously. When the voltage across the power source 14 exceeds 5 volts, the control switch 20 is closed as shown in FIG. 3, since the control unit 15 starts to operate in the same way as when the key switch 10 is first actuated to the primary operative position in which the movable contact 11 is in contact with the first fixed contact 12.

Even under conditions where the voltage across the power source 14 drops below 5 volts so that the control switch 20 is opened, the relay winding 18 remains energized by the power source 14 and thus the relay switch 19 keeps closed as shown in FIG. 3, since the relay switch 24 remains closed as described previously. In this way, the glow plug section 21 remains continuously activated.

When the key switch 10 is returned from the secondary operative position to the primary operative position so that the movable contact 11 separates from the fixed contact 13 but maintains contact with the other fixed contact 12, the starting motor 16 is deactivated and the relay winding 23 is de-energized. De-energization of the relay winding 23 opens the relay switch 24 as shown at the time point $A_3$ of FIG. 3. Deactivation of the starting motor 16 causes the voltage across the power source 14 to increase to, e.g., 7.5 volts. In this case, the control unit 15 is generally operative to keep the control switch 20 closed as shown in FIG. 3 so that the glow plug section 21 still continues to be activated.

When the rotational speed of the crankshaft derived from the engine speed signal S exceeds a reference value as a result of engine cranking prior to deactivating the starting motor 16, the control unit 15 opens the control switch 20 as shown at a time point $A_4$ of FIG. 3. This reference speed is chosen so as to represent conditions under which self-sustaining operation of the engine is reliably attained. Opening the control switch 20 causes the relay winding 18 to be de-energized, thereby opening the relay switch 17 as shown at the time point $A_4$ of FIG. 3 and deactivating the glow plug unit 21.

The period of time during which the glow plug section 21 is continuously activated is limited to a predetermined value to prevent the glow plug section 21 from being damaged. The control unit 15 realizes this limitation by opening the control switch 20 forcedly.

It should be noted that a fuel supply control system including a fuel injection pump supplies a required rate of fuel to the engine during and after cranking to enable start-up and self-sustaining operation of the engine. The relays 17 and 22 need to be designed such that the respective relay switches 19 and 24 can remain closed even when the voltage across the power source 14 drops below the minimum rating value for the control unit 15 but to a level somewhat higher than zero volt.

Figure 4:
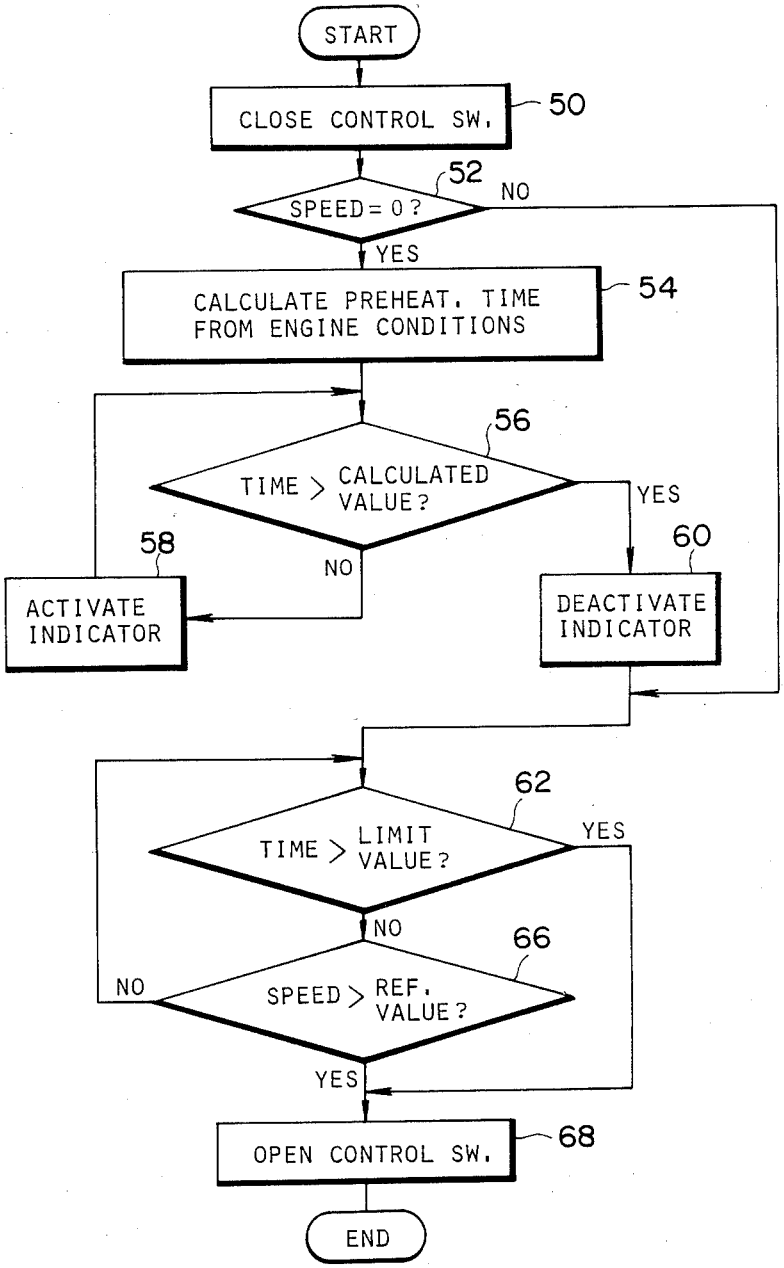
FIG. 4 is a flow chart of a program defining operation of the control unit of FIG. 1.

FIG. 4 is an example of a flow chart of a program controlling operation of the control unit 15. When the key switch 10 is actuated from the rest or open position to the primary operative position at which the movable contact 11 is in contact with the first fixed contact 12, the control unit 15 starts operation in a step 50.

In the step 50, the control unit 15 closes the control switch 20 to activate the glow plug section 21.

In a step 52 subsequent to the step 50, the control unit 15 determines whether or not the rotational speed of the crankshaft derived from the engine speed signal S is equal to zero, that is, whether or not the crankshaft is moving. If the crankshaft is at rest, operation of the control unit 15 proceeds to a step 54. If the crankshaft is rotating, operation of the control unit 15 proceeds to a step 62.

In the step 54, the control unit 15 calculates the period of time necessary to complete preheating by the glow plug section 21 on the basis of the engine temperature and the time elapsed since the engine was last turned off derived from the signals Tw and t respectively. This calculation is achieved by using a preset equation so configured that the preheating time increases as the engine temperature decreases and/or as the time elapsed since the previous operation of the engine increases. Specifically, if the engine temperature is higher than a reference value representing that preheating is unnecessary, the preheating time is set equal to zero to prevent the glow plug section 21 from being activated for an unnecessarily long time. The increases in the preheating time in accordance with the increases in the time elapsed since the previous engine operation are to prevent the glow plug section 21 from being activated for an undesirably or unnecessarily long time to start the engine immediately or slightly after the engine is turned off.

The preheating time calculating equation may also be arranged such that the preheating time depends only on the engine temperature. In this case, the time sensor 26 can be eliminated.

In a step 56 subsequent to the step 54, the control unit 15 determines whether or not the period of time elapsed since the closing of the control switch 20 exceeds the calculated preheating time. For this purpose, the I/O circuit 30 of the control unit 15 includes a time-measuring circuit triggered when the control switch 20 closes. If this period of time does not exceed the calculated preheating time, operation of the control unit 15 proceeds to a step 58. If this period of time exceeds the calculated preheating time, operation of the control unit 15 proceeds to a step 60.

In the step 58, the control unit 15 activates the indicator 28 to report that preheating is not yet finished. After the step 58, operation of the control unit 15 returns to the step 56.

In the step 60, the control unit 15 deactivates the indicator 28 to report that preheating has been completed. In this way, the indicator 28 remains activated until preheating is completed. After the step 60, operation of the control unit 15 proceeds to the step 62.

In the step 62, the control unit 15 determines whether or not the period of time elapsed since the closing of the control switch 20 exceeds a preset limit representing over-activation of the glow plug section 21. If this period of time exceeds the preset limit, operation of the control unit 15 proceeds to a step 68. If this period of time does not exceed the preset limit, operation of the control unit 15 proceeds to a step 66.

In the step 66, the control unit 15 determines whether or not the rotational speed of the crankshaft derived from the engine speed signal S exceeds a reference value representing conditions under which self-sustaining operation of the engine can be attained. If the rotational speed of the crankshaft does not exceed the reference value, operation of the control unit 15 returns to the step 62. If the rotational speed of the crankshaft exceeds the reference value, operation of the control unit 15 proceeds to the step 68.

In the step 68, the control unit 15 opens the control switch 20 to deactivate the glow plug section 21. After the step 68, operation of the control unit 15 ends.

In this way, the glow plug section 21 remains activated until the rotational speed of the crankshaft exceeds the self-sustaining value, provided that the period of time elapsed after the control switch 20 is closed is less than the preset limit.

When the voltage across the power source 14 drops below the minimum rating value, the control unit 15 becomes inactive. Thereafter, when the voltage across the power source 14 returns to above the minimum rating value, the program sequence of the control unit 15 is automatically reset to start at the first step 50. During engine cranking, when the voltage across the power source 14 returns to above the minimum rating value, operation of the control unit 15 passes from the step 52 directly to the step 62 after the step 50. Therefore, the indicator 28 remains deactivated in this case.

Figure 5:
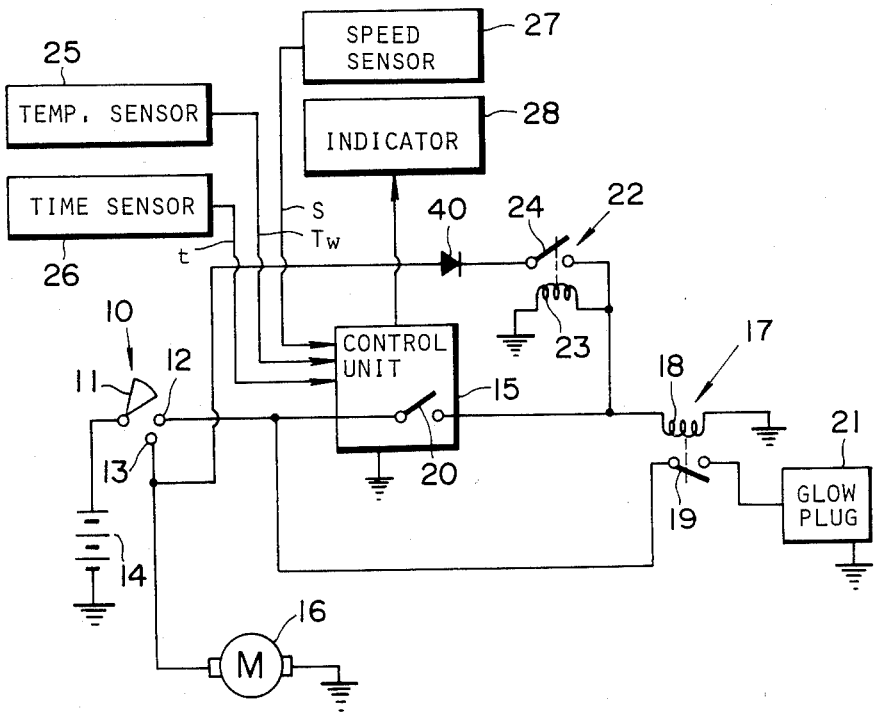
FIG. 5 is a diagram of a similar control system according to a second embodiment of this invention.

FIG. 5 shows a second embodiment of this invention, which is designed in a manner similar to the first embodiment except for the following arrangements:

One end of the relay winding 18 is grounded, and the other end of the relay winding 18 is connected to the first fixed contact 12 of the key switch 10 via the control switch 20.

The anode of the diode 40 is connected to the second fixed contact 13 of the key switch 10. The cathode of the diode 40 is connected to the junction between the control switch 20 and the relay winding 18 via the relay switch 24. The junction between the control switch 20 and the relay winding 18 is grounded via the relay winding 23.

Operation of the second embodiment is similar to that of the first embodiment.

It should be understood that further modifications and variations may be made in this invention without departing from the spirit and scope of this invention as set forth in the appended claims.

What is claimed is:

1. A control system for a glow plug of an internal combustion engine equipped with a starting motor, comprising:

(a) first means for selectively activating and deactivating the glow plug;

(b) a microcomputer system connected to the first means for controlling the first means;

(c) a DC power source electrically connected to the microcomputer system and the starting motor for supplying DC electrical power to the microcomputer system and the starting motor to activate them, the microcomputer system becoming inactive and causing the first means to deactivate the glow plug when the voltage of the DC electrical power drops below a minimum rating value; and (d) a switch disposed in the electrical connection between the starting motor and the power source for selectively effecting and interrupting activation of the starting motor; and (e) second means for activating the glow plug when the switch effects activation of the starting motor regardless of whether or not the voltage of the DC electrical power drops below the minimum rating value.

2. A control system as recited in claim 1, wherein the second means is operative to continuously activate the glow plug while the switch effects activation of the starting motor, provided that the microcomputer system causes the first means to activate the glow plug when the switch first initiates effecting activation of the starting motor.

3. A control system as recited in claim 2, wherein the second means includes a second switch and a relay winding for actuating the second switch, the relay winding being connected in series with the second switch, the series combination of the relay winding and the second switch being connected to the power source via the first switch, the series combination of the relay winding and the second switch being associated with the first means for activating the glow plug when the first switch effects activation of the starting motor regardless of whether or not the voltage of the DC electrical power drops below the minimum rating value.

* * * * *

UNITED STATES PATENT AND TRADEMARK OFFICE

CERTIFICATE OF CORRECTION

PATENT NO. : 4,491,100

DATED : January 1, 1985

INVENTOR(S) : Seishi Yasuhara

It is certified that error appears in the above-identified patent and that said Letters Patent is hereby corrected as shown below:

Cover Page, after item [22], insert item --[30] Foreign Application Priority Data June 14, 1982 [JP] Japan ..... 57-87372--

Signed and Sealed this

*Twenty-fifth* Day of *June 1985*

[SEAL]

*Attest:*

DONALD J. QUIGG

*Attesting Officer*

*Acting Commissioner of Patents and Trademarks*